US008096383B2

(12) United States Patent
Saltykov et al.

(10) Patent No.: US 8,096,383 B2
(45) Date of Patent: Jan. 17, 2012

(54) TAPERED VENT FOR A HEARING INSTRUMENT

(75) Inventors: Oleg Saltykov, Fairlawn, NJ (US); Fred McBagonluri, East Windsor, NJ (US)

(73) Assignee: Siemens Hearing Instruments Inc., Piscataway, NJ (US)

( * ) Notice: Subject to any disclaimer, the term of this patent is extended or adjusted under 35 U.S.C. 154(b) by 1495 days.

(21) Appl. No.: 11/386,063

(22) Filed: Mar. 21, 2006

(65) Prior Publication Data

US 2007/0223757 A1 Sep. 27, 2007

(51) Int. Cl.
*H04R 25/02* (2006.01)
*H04R 25/00* (2006.01)

(52) U.S. Cl. ..... 181/135; 381/324

(58) Field of Classification Search ..... 181/135, 181/130; 381/324, 325, 328
See application file for complete search history.

(56) References Cited

U.S. PATENT DOCUMENTS

| | | | | | |
|---|---|---|---|---|---|
| 2,312,534 | A * | 3/1943 | Flene | 181/135 |
| 3,368,644 | A * | 2/1968 | Henderson | 181/129 |
| 3,470,328 | A * | 9/1969 | Daniels | 381/322 |
| 3,702,123 | A * | 11/1972 | Macken et al. | 181/135 |
| 4,069,400 | A * | 1/1978 | Johanson et al. | 381/324 |
| 4,375,016 | A * | 2/1983 | Harada | 181/135 |
| 4,442,917 | A * | 4/1984 | Johnson | 181/135 |
| 4,532,649 | A * | 7/1985 | Bellafiore | 381/324 |
| 4,712,245 | A * | 12/1987 | Lyregaard | 381/324 |
| 4,729,451 | A * | 3/1988 | Brander et al. | 181/130 |
| 4,811,402 | A * | 3/1989 | Ward | 381/322 |
| 4,852,177 | A * | 7/1989 | Ambrose | 381/338 |
| 4,870,688 | A * | 9/1989 | Voroba et al. | 381/60 |
| 4,878,560 | A * | 11/1989 | Scott | 181/130 |
| 4,879,750 | A * | 11/1989 | Nassler | 381/325 |
| 4,974,606 | A * | 12/1990 | Van Mierlo | 128/864 |
| 5,068,902 | A * | 11/1991 | Ward | 381/328 |
| 5,099,947 | A * | 3/1992 | Guggenberger et al. | 181/130 |
| 5,195,139 | A * | 3/1993 | Gauthier | 381/322 |
| 5,278,360 | A * | 1/1994 | Carbe et al. | 181/135 |
| 5,321,757 | A * | 6/1994 | Woodfill, Jr. | 381/312 |
| 5,327,500 | A * | 7/1994 | Campbell | 381/325 |
| 5,535,282 | A * | 7/1996 | Luca | 381/328 |
| 5,875,254 | A * | 2/1999 | Hanright | 381/329 |
| 6,105,713 | A * | 8/2000 | Brimhall et al. | 181/135 |
| 6,249,587 | B1 * | 6/2001 | Clavadetscher et al. | 381/322 |
| 6,339,648 | B1 * | 1/2002 | McIntosh et al. | 381/328 |
| 6,359,993 | B2 * | 3/2002 | Brimhall | 381/328 |
| 6,549,635 | B1 * | 4/2003 | Gebert | 381/324 |
| 6,661,901 | B1 * | 12/2003 | Svean et al. | 381/328 |
| 6,728,383 | B1 * | 4/2004 | Juneau et al. | 381/322 |
| 6,754,359 | B1 * | 6/2004 | Svean et al. | 381/328 |
| 6,819,770 | B2 * | 11/2004 | Niederdrank | 381/322 |
| 7,025,061 | B2 * | 4/2006 | Haussmann | 128/864 |
| 7,079,662 | B2 * | 7/2006 | Niederdr nk | 381/328 |

(Continued)

FOREIGN PATENT DOCUMENTS

| | | | |
|---|---|---|---|
| CH | 681125 A5 * | 1/1993 |
| WO | WO 9203894 A1 * | 3/1992 |

*Primary Examiner* — Edgardo San Martin
(74) *Attorney, Agent, or Firm* — Francis G. Montgomery

(57) ABSTRACT

A vent having a reduced cross-section or taper permits the fabrication of very small hearing instruments while providing the necessary openings for the receiver tube and the vent in the tip of the instrument. The reduced cross-section provides sufficient clearance for the full cross-section of the receiver tube, without sacrificing the performance of the vent. The modified vent may be created in a CAD environment using Boolean modeling operations.

9 Claims, 14 Drawing Sheets

U.S. PATENT DOCUMENTS

| | | | | |
|---|---|---|---|---|
| 7,401,680 | B2 * | 7/2008 | Kurth | 181/135 |
| 2002/0136420 | A1 * | 9/2002 | Topholm | 381/312 |
| 2002/0196954 | A1 * | 12/2002 | Marxen et al. | 381/312 |
| 2003/0074174 | A1 * | 4/2003 | Fu et al. | 703/13 |
| 2004/0107080 | A1 * | 6/2004 | Deichmann et al. | 703/6 |
| 2004/0218772 | A1 * | 11/2004 | Ryan | 381/328 |
| 2005/0141739 | A1 * | 6/2005 | Juneau et al. | 381/322 |
| 2005/0286731 | A1 * | 12/2005 | Shennib et al. | 381/322 |
| 2006/0045297 | A1 * | 3/2006 | Haussmann | 381/322 |
| 2007/0003085 | A1 * | 1/2007 | Meier et al. | 381/328 |
| 2007/0206826 | A1 * | 9/2007 | Rohrlein | 381/325 |
| 2008/0118095 | A1 * | 5/2008 | Fletcher | 381/328 |

* cited by examiner

TAPERED VENT FOR A HEARING INSTRUMENT

CROSS-REFERENCE TO RELATED APPLICATIONS

This application is related to the following U.S. Patent Application(s), incorporated herein by reference: Ser. No. 09/887,939 filed Jun. 22, 2001.

BACKGROUND AND SUMMARY OF THE INVENTION

Hearing instruments, i.e., devices that assist the hearing impaired, designed for complete or partial insertion into the user's ear canal, have a shell or housing that holds various components. One such component is the receiver, which generates the sound heard by the hearing instrument's user. The sound is carried from the receiver by a receiver tube affixed to a port on the receiver to an opening (the receiver tube hole) in the tip of the shell, the portion of the hearing instrument positioned in the ear canal towards the eardrum.

Another feature of a hearing instrument is a vent, a conduit from the inner ear to the outside. When a person speaks, vibration is generated in the bone structure of their head, creating sound pressure in the inner ear. Normally, this sound pressure escapes if the ear canal is not occluded. However, if a hearing instrument is inserted into the ear, occluding the ear canal, the hearing instrument user will perceive an unpleasant, hollow sound, a phenomenon known as the occlusion effect. A hearing instrument vent will provide relief, allowing at least some of the sound pressure to escape from the inner ear. A vent also permits the pressure in the ear to equalize with respect to the outside when the hearing instrument is inserted into the ear. An opening provided in the shell tip serves as the inlet for the vent.

If the hearing instrument shell is small in size, there may not be sufficient room to accommodate the full diameters or cross-sections of both the receiver tube hole and the vent hole, and the underlying receiver tube and vent. (The receiver tube and the vent may have circular cross-sections or any other suitable cross-section.) Some arrangement is then required to provide room for the receiver tube and vent in the shell tip, as well as openings for the receiver tube and the vent on the surface of the shell tip, such that they do not interfere with each other.

A Tapered Vent

By reducing the cross-section of the vent tube near the tip of the shell, the vent hole can be made smaller, allowing for a receiver tube hole equal to the full cross-section of the receiver tube. A reduction in the cross-section may be achieved by introducing a taper to the vent as it reaches the end of the tip and the vent hole or otherwise providing a vent of smaller cross-section. The cross-section of the vent is reduced only in the vicinity of the tip, preserving its full cross-section elsewhere in the instrument. Computer-aided design (CAD) techniques, including Boolean operations, may be utilized to create the smaller vent and vent hole.

DESCRIPTION OF THE INVENTION

Figure 1:
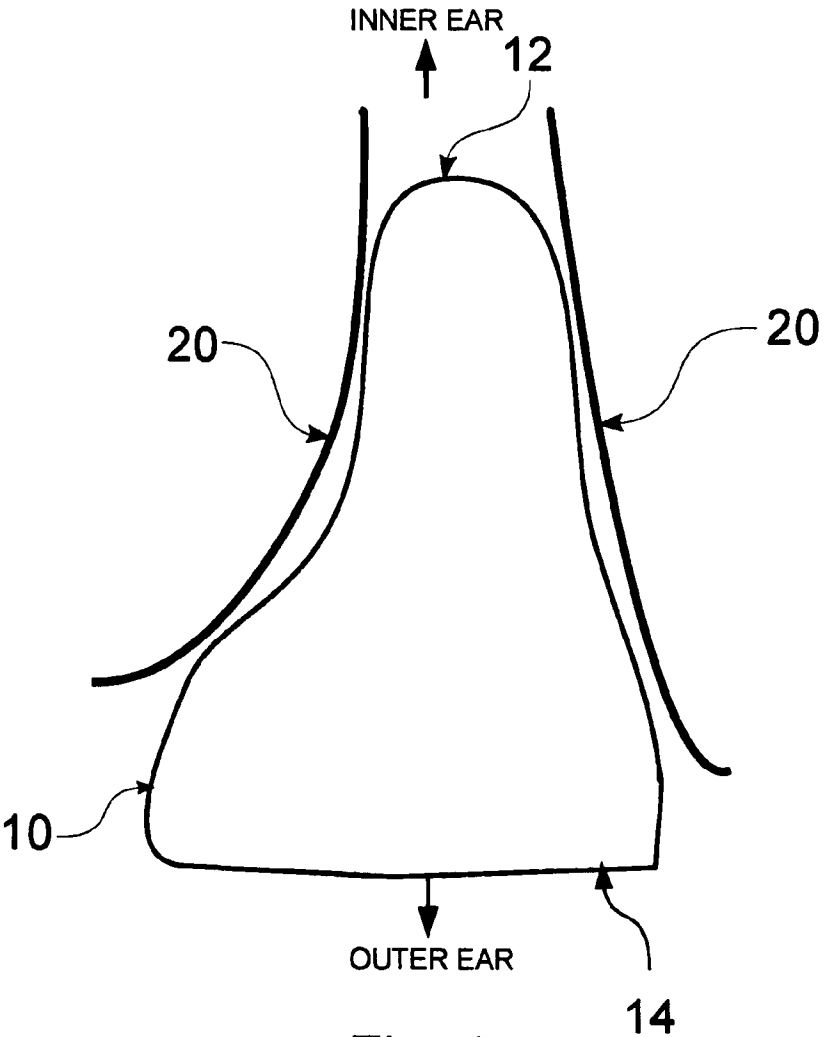
FIG. 1 illustrates a hearing instrument positioned in the ear canal.

FIG. 1 illustrates a hearing instrument, which has an outer shell or housing 10 positioned as least partially in the ear canal, adjacent the walls 20 of the canal of the person wearing the hearing instrument. The hearing instrument shell 10 has a tip 12—the section of the shell 10 inserted into the ear canal—oriented towards the inner ear and a faceplate 14 oriented towards the outer ear.

Figure 2:
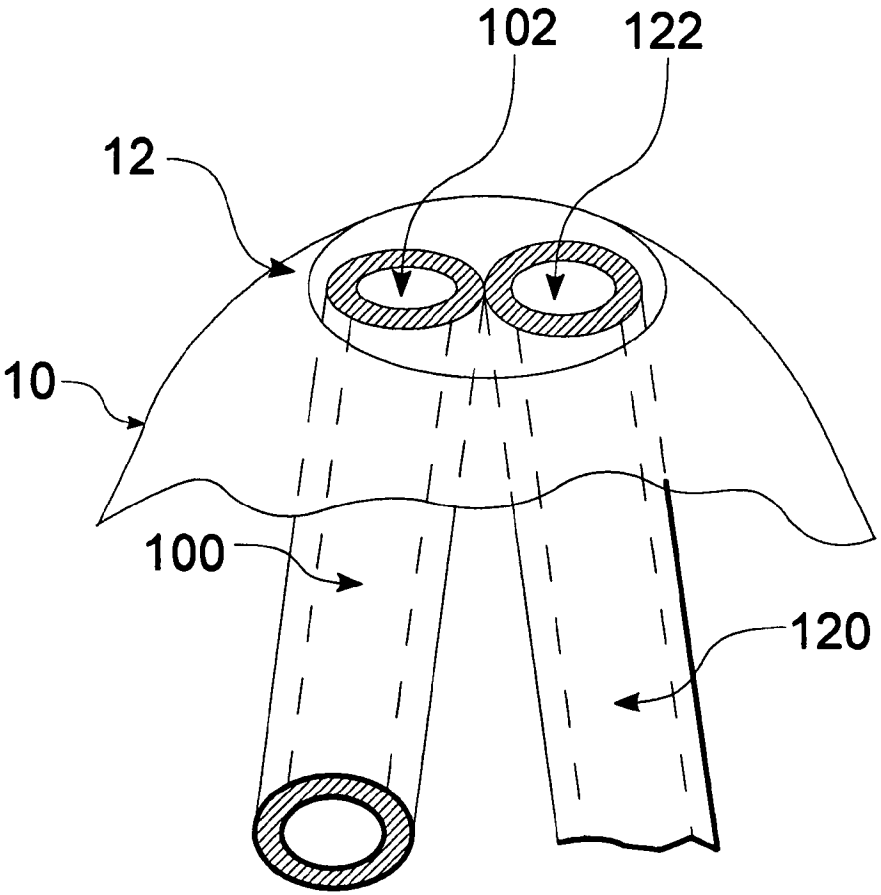
FIG. 2 is a partial cross-sectional view of a hearing instrument comprising a receiver tube and vent.

FIG. 2 illustrates a partial cross-sectional view of the hearing instrument shell 10. The only parts of the hearing instrument shown in this figure are the receiver tube 100, the vent 120, and a portion of the shell 10.

The vent 120 may be fabricated as a channel on the inside wall of the shell 10, but is shown here as a cylindrical object. One could choose to create a vent using either configuration. For example, the vent could be realized as a separate tube similar to the receiver tube 100.

The receiver tube 100 exits the shell 10 at a receiver tube hole 102 and the vent 120 has a port at a vent hole 122. As illustrated in FIG. 2, the tip 12 of the shell 10 has sufficient area to accommodate openings (i.e., the receiver tube hole 102 and the vent hole 122) for the full circumferences of the respective receiver tube 100 and the vent 120, as well as sufficient volume within the tip 12 for the receiver tube 100 and the vent 120.

In FIG. 2, the receiver tube 100 and the vent 120 are immediately adjacent one another. If hearing instrument tip 12, there would not be sufficient room to position the receiver tube 100 and the vent 120 side-by-side, as well as provide openings for the full circumferences of the receiver tube and the vent, without interference.

Figure 3:
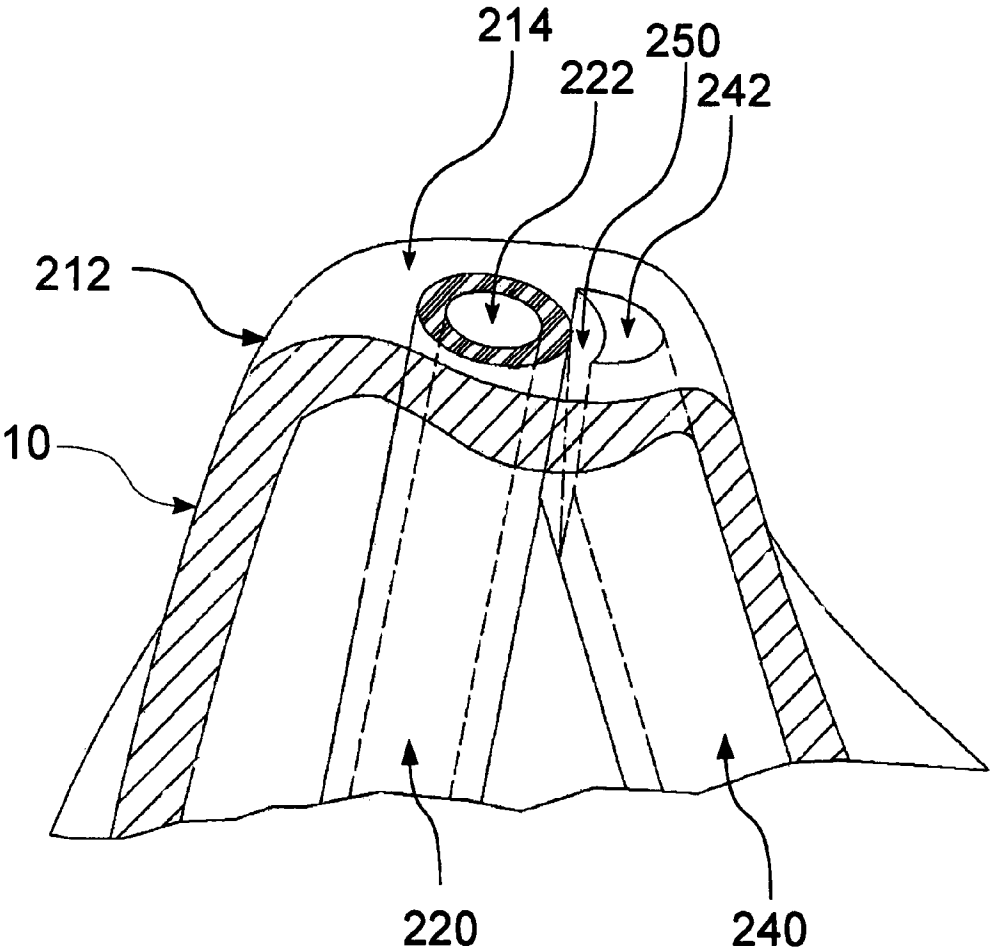
FIGS. 3 and 4 are partial cross-sectional views of hearing instrument shells comprising a receiver tube and a tapered vent.
Figure 4:
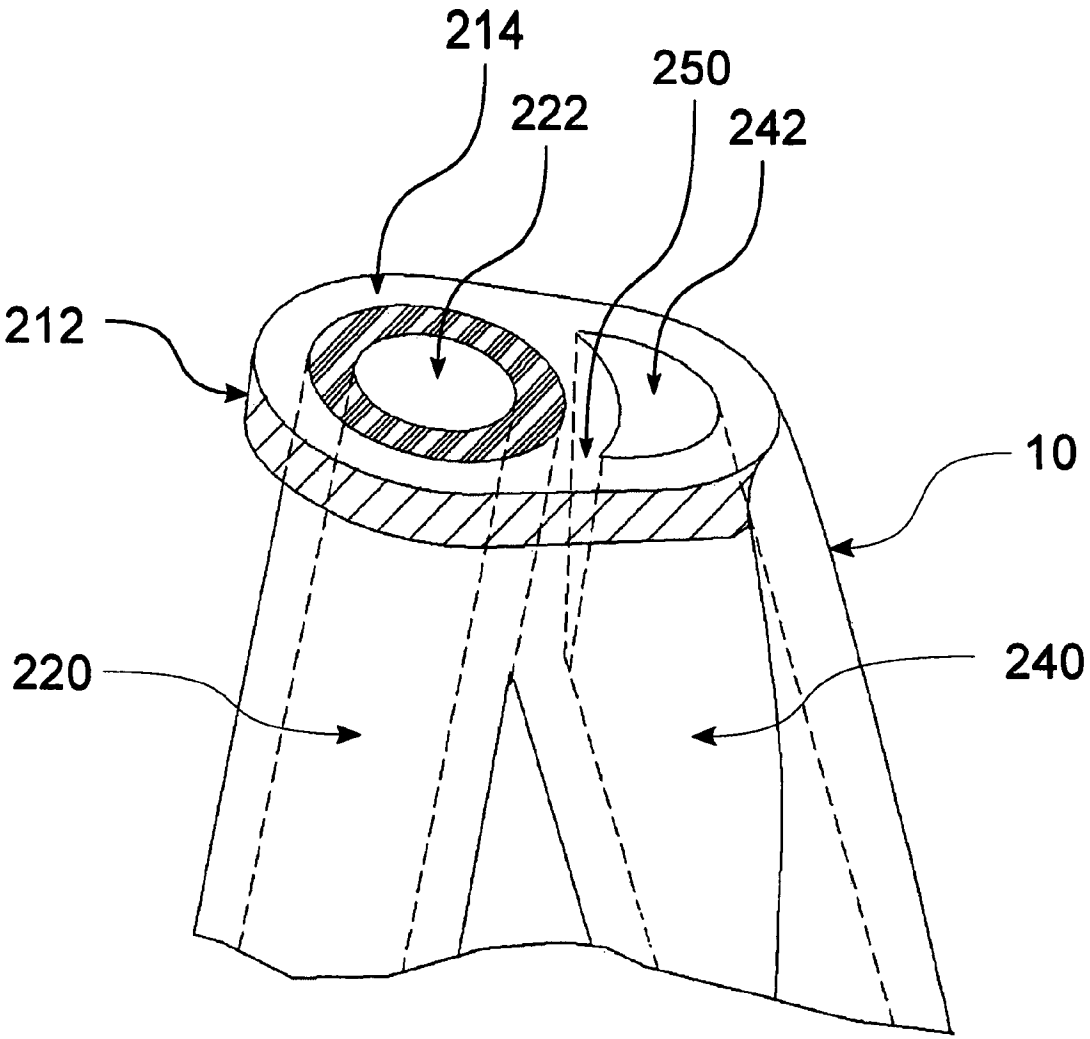

An arrangement illustrating a smaller shell tip 212 is shown in FIGS. 3 and 4. There, the housing or shell 10 comprises a receiver tube 220 and a vent 240, and the end region or shell tip surface 214 of the shell tip 212 comprises a receiver tube hole 222 and a vent hole 242. The vent 240 has a reduced cross-section in the vicinity of the shell tip 212 where it is adjacent the receiver tube 220.

As illustrated in FIGS. 3 and 4, a cutaway section or taper 250 has been applied to the vent 240 near the shell tip 212. Given the smaller cross-section of the vent 240, the vent hole 242 similarly requires less surface area on the shell tip surface 214 and its shape conforms to the tapered outline of the vent 240 where it intersects the shell tip 212. However, the vent 240 is tapered only for a short distance and resumes its otherwise full circumference or cross-section below the shell tip 212 where the full cross-section of the vent 240 would no longer interfere with the receiver tube 220. The taper 250 begins inside the shell 200 at the point 224 where the receiver tube 220 first meets the vent 240 and continues as the vent 240 narrows until the shell tip surface 214 is reached, where the receiver tube 220 terminates in the receiver tube hole 222, and the vent 240 terminates in the vent hole 242.

Figure 7:
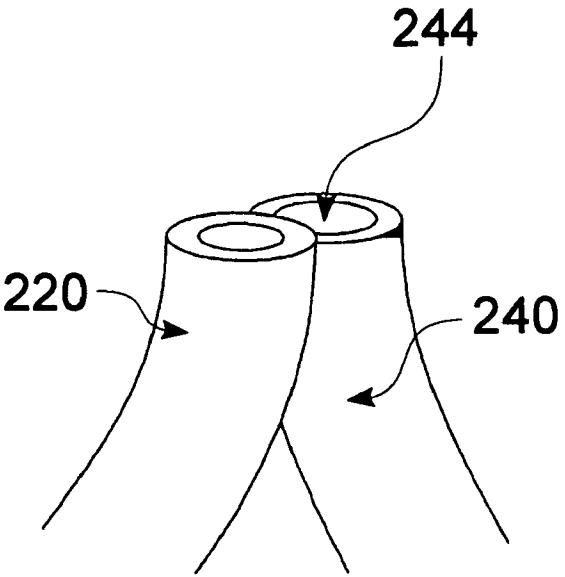
FIGS. 5-9 illustrate processes for tapering the vent in view of the receiver tube.
Figure 6:
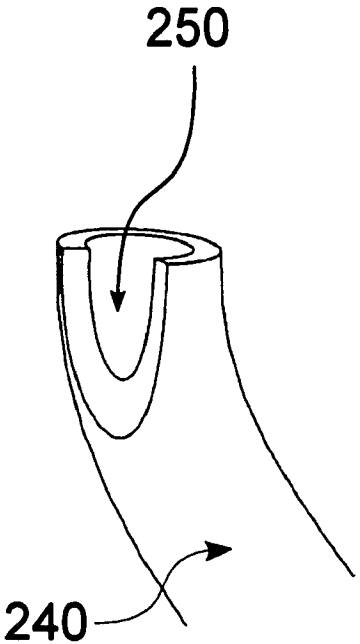
Figure 5:
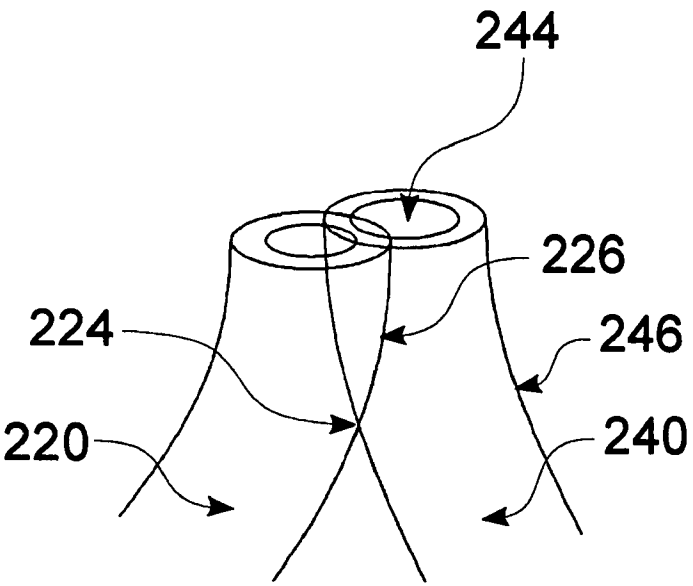

Utilizing depictions of the receiver tube 220 and the vent 240, FIGS. 5-7 illustrate a process for creating the taper in the vent 240. In the example shown in FIGS. 5 and 6, a portion of the vent 240 is removed using the surface 226 of the receiver tube 220 as a cutting tool, leaving a cutaway section or taper 250. The receiver tube 220 is then positioned against the vent 240 at the location where the material has been removed, as illustrated in FIG. 7. In a rapid prototyping or direct manufacturing environment, this process could be achieved by fabricating a vent with a reduced cross-section or taper already in place and thus not requiring a machining or cutting operation.

Figure 9:
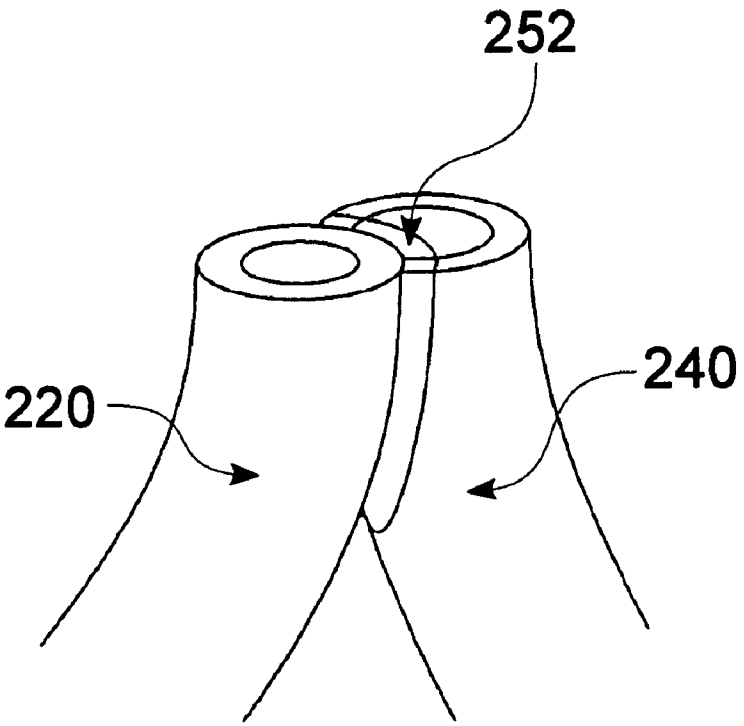
Figure 8:
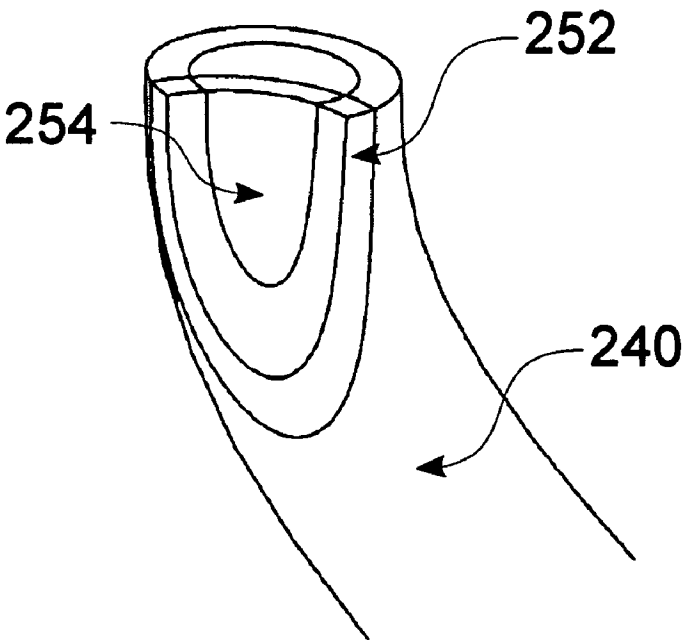

If the receiver tube 220 penetrates the interior 244 of the vent 240 (see FIGS. 5 and 7), the surface 246 of the vent 240 in the region of the cutaway section 250 may be reconstructed with a wall section 252, as illustrated in FIG. 8. The wall section 252 may be concave and can be created using the Boolean intersection of the surface 226 of the receiver tube 220 and the surface 246 of the vent 240. Depth (i.e., thickness) may be provided for the wall section 252 by offsetting the surface resulting from the Boolean intersection a distance equal to the desired thickness. Here again, the wall section 252 can be fabricated directly as part of the vent 240 using rapid prototyping or direct manufacturing techniques. Since the receiver tube 220 may be a tubular component physically separate from the shell 10, the wall section 252 seals the vent 240 and prevents sound from leaking where the receiver tube 220 would otherwise adjoin the vent 240. Instead, the receiver tube 220 and the wall section 252 sit adjacent each other as shown in FIG. 9.

Figure 11:
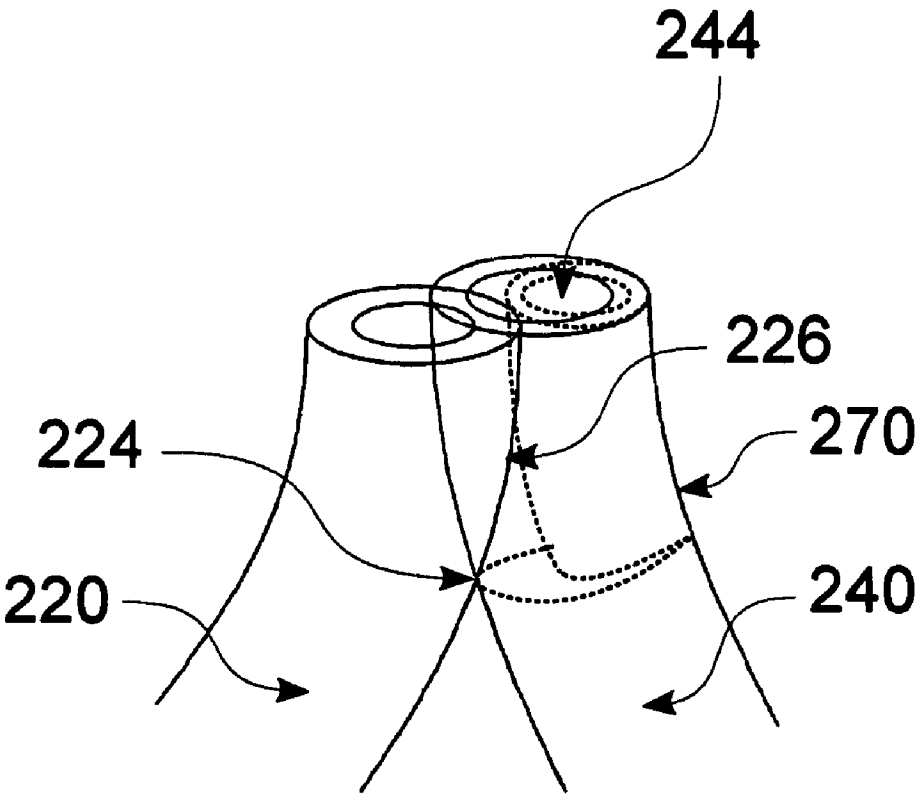
FIG. 11 is a partial cross-sectional view of a hearing instrument shell comprising a receiver tube and a vent having a cylindrical section of reduced diameter.

As an alternative to tapering the vent in the vicinity of the tip, the receiver tube 220 could be tapered, or both the vent 240 and the receiver tube 220 could be tapered. Also, the reduction in cross section of either the receiver tube 220 or the vent 240 could be achieved without applying the taper or shape conforming to the receiver tube 220 shown in FIGS. 3-9. For example, as illustrated in FIG. 11, the vent 240 could have a cylindrical section 270 of reduced diameter in the area between the vent hole 242 and the point in space (224) where the vent 240 and the receiver tube 220 would not physically interfere.

Figure 10:
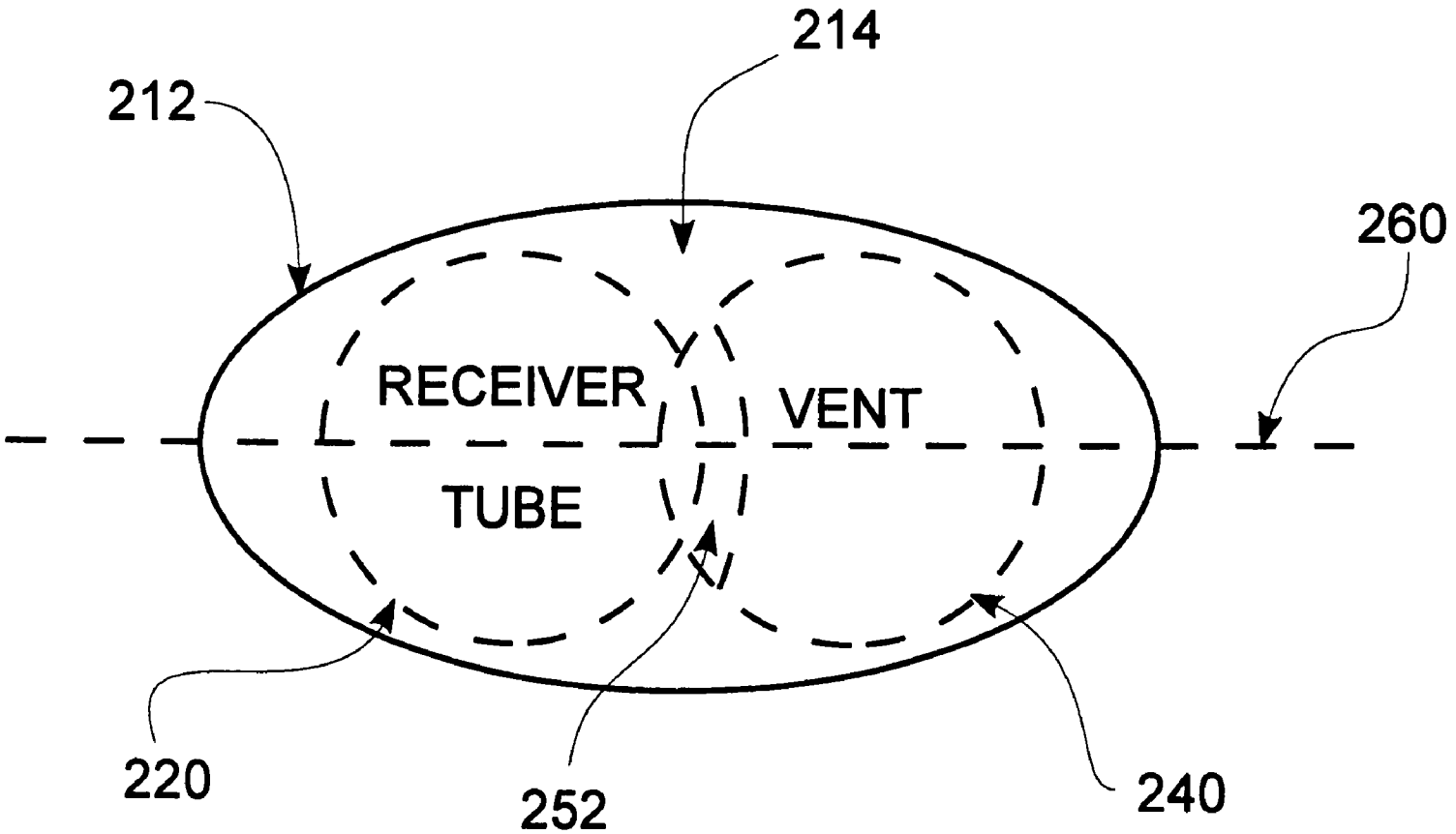
FIG. 10 is a drawing of the tip surface.
Figure 12:
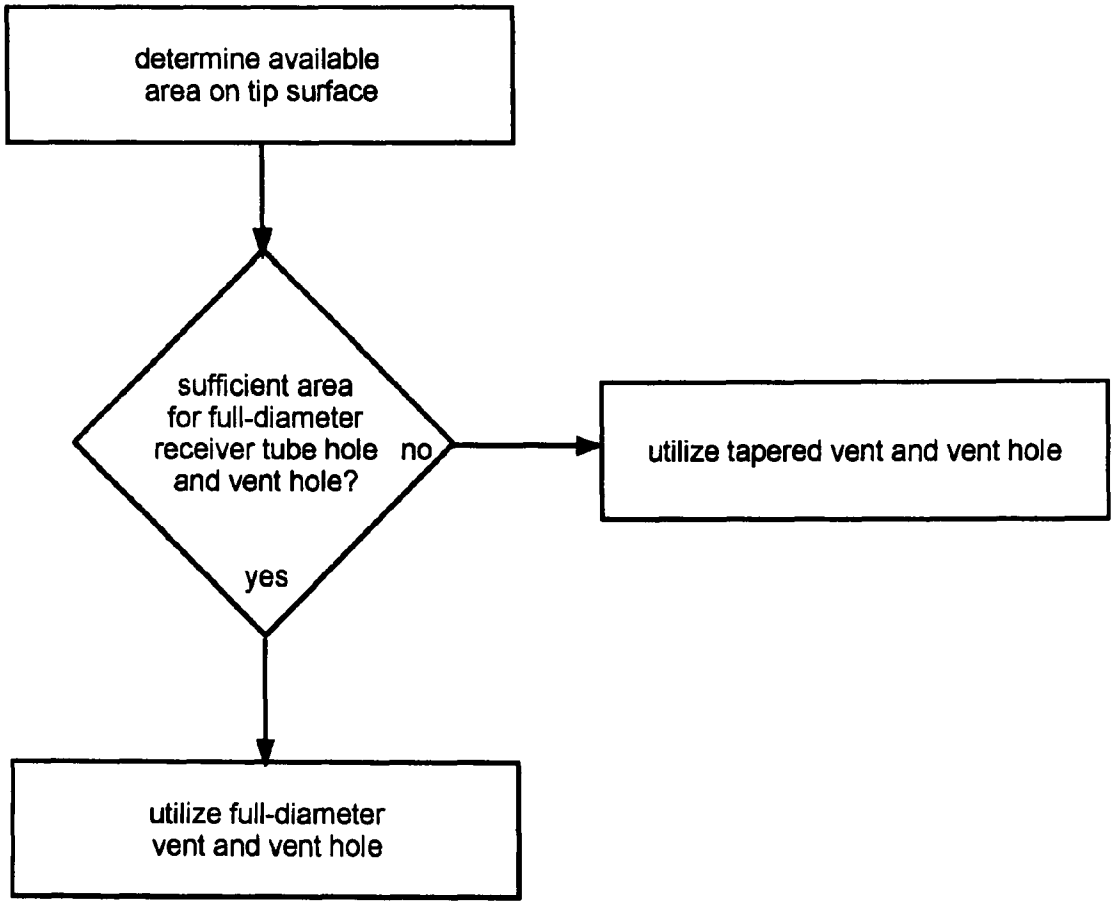
FIGS. 12-15 are flow charts of processes for manufacturing the hearing instrument.

In the following discussion, the hearing instrument shell 10 is modeled in virtual space, using well-known computer-aided design (CAD) tools, including Boolean modeling operations. As illustrated in FIG. 10, the shell tip surface 214 of the shell tip 212 may be roughly elliptical in shape. As a design choice, the centers of the receiver tube 220 and the vent 240 can be positioned on the major axis 260 of the shell tip surface 214. If the receiver tube 220 and vent 240 do not interfere with each other, as is the case in FIG. 2, then no modification is required of either. However, if there is insufficient area to position both the receiver tube and the vent and their respective openings in the shell tip 212, then a portion of either the vent hole 242 or the receiver tube hole 222 must be removed. This determination is set forth in the flow chart of FIG. 12.

As shown in FIGS. 5-7, the vent tube hole 242 and the vent 240 can be trimmed (or tapered) to accommodate the receiver tube hole 222 and the receiver tube 220. Therefore, in this arrangement, the dimensions of the receiver tube 220 and the receiver tube hole 222 are protected, maintaining their full cross-sections.

Figure 13:
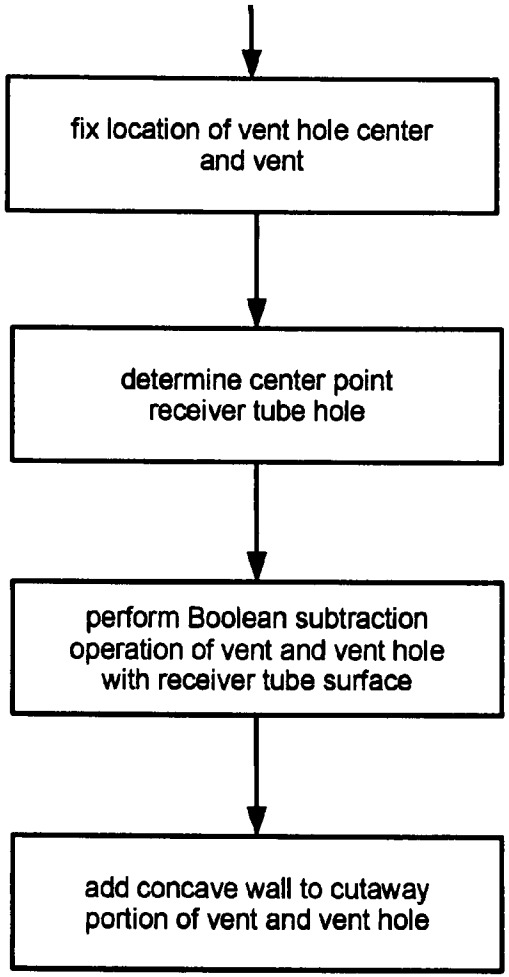

Utilizing the steps set forth in the flow chart of FIG. 13, the location of the vent 240 and the vent hole 242 are fixed. Next, the location of the receiver tube hole 222 is then determined. Using the surface 226 of the virtual receiver tube 220 as a cutting tool, a Boolean subtraction operation may be performed on the vent tube 240 and the vent hole 242, removing material from both. If desired, a wall 252 of predetermined thickness may be added to the vent 220. A Boolean intersection operation may be used to generate the outer surface 254 of the wall 252. By "growing" the wall 252 inwardly (i.e., towards the interior 244 of the vent 240 proper), the wall 252 is given a desired thickness.

Figure 14:
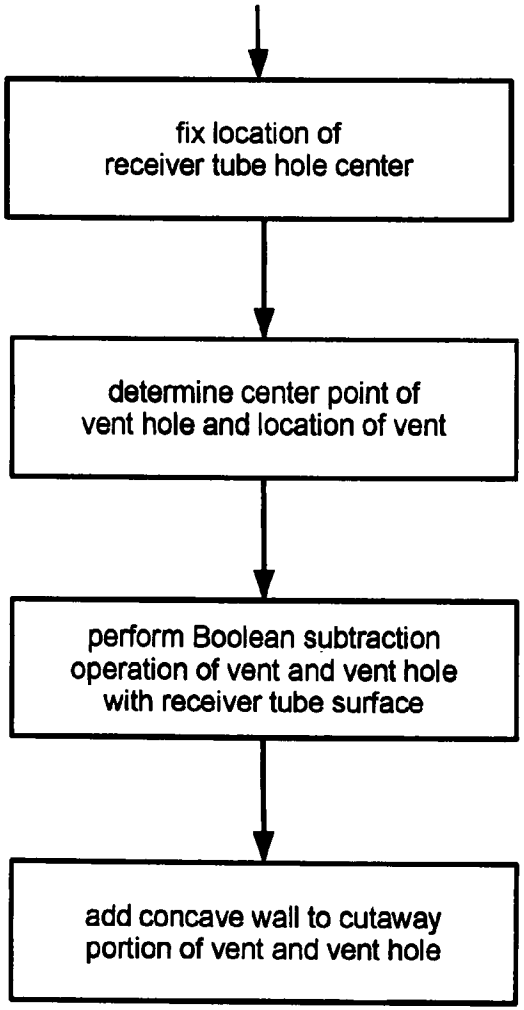

Instead of first positioning the vent hole 242, the receiver tube hole 222 and receiver tube 220 positions could be fixed, as outlined in the flow chart of FIG. 14. Then, the respective locations and positions of the vent hole 242 and vent 240 would be determined and moved into place using a Boolean subtraction based on the surface of the receiver tube 220. Finally, a wall 252 can be added if desired.

Figure 15:
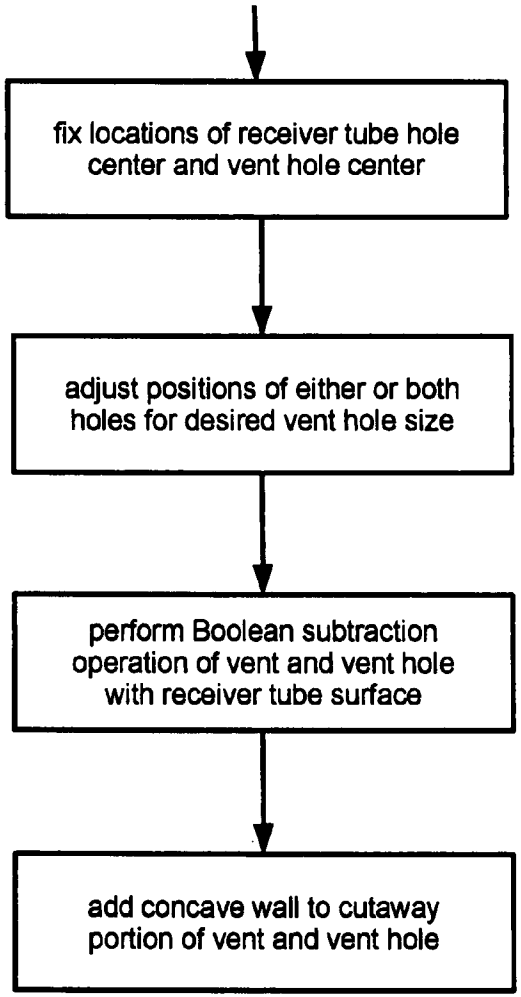
Figures 16, 17, 18:
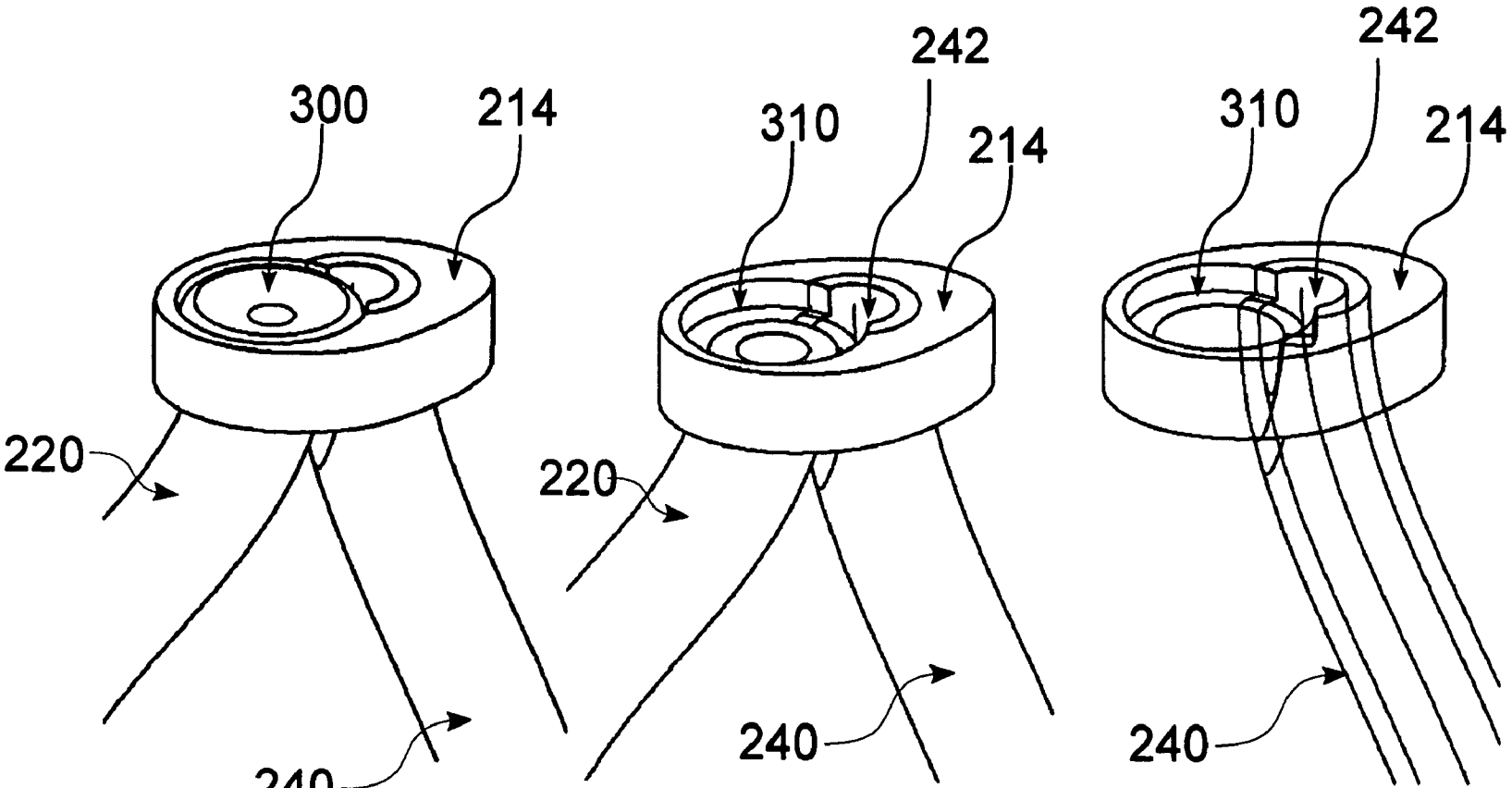
FIGS. 16-20 illustrate an arrangement for accommodating a wax guard.
Figure 20:
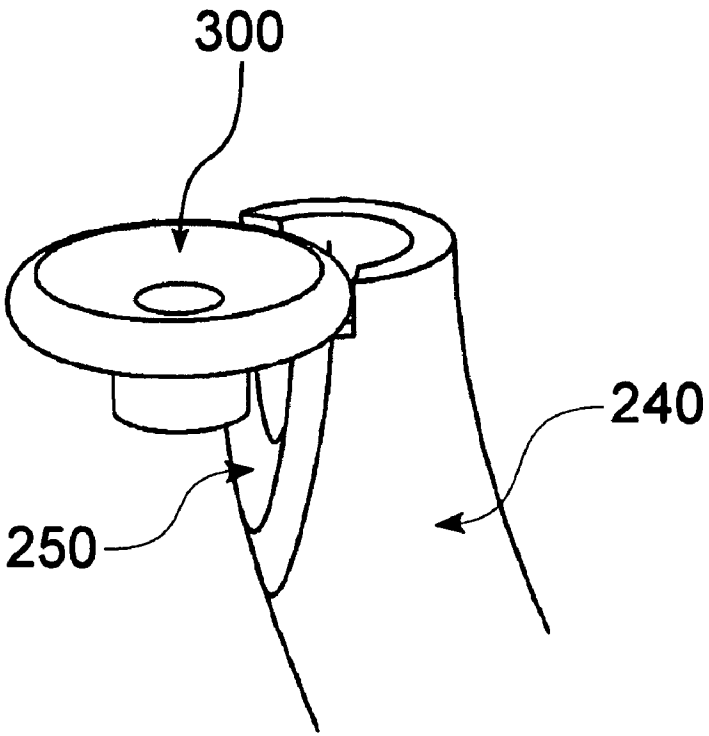
Figure 19:
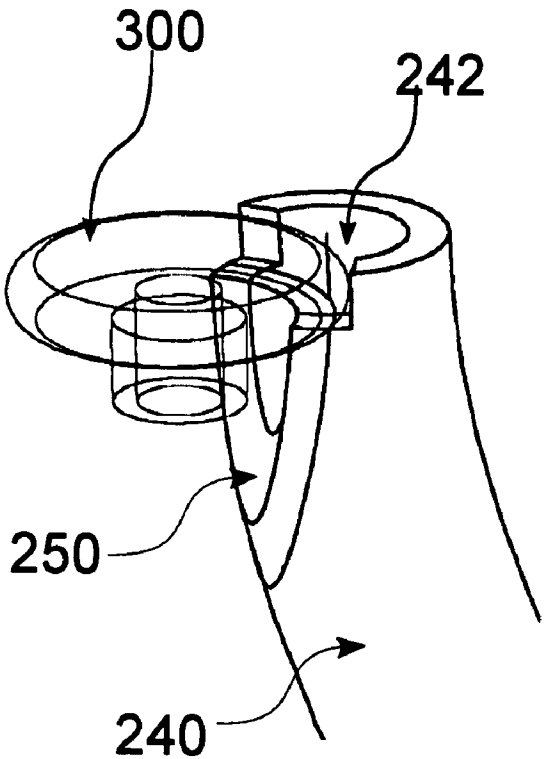

The flow chart of FIG. 15 offers a third method of locating the receiver tube and vent holes. In this option, the locations of both the receiver tube hole 222 and the vent hole 242 are selected at the same time, adjusting them as necessary to provide the desired size for the vent hole 242. As in the other methods discussed here (FIGS. 13 and 14), the surface of the receiver tube 220 is used to perform a Boolean subtraction of the interfering portion of the vent 240. Finally, a wall 252 may be added based on the Boolean intersection of the receiver tube 220 and the vent 240.

In some hearing instruments, wax guards are provided to keep cerumen, the waxy buildup in the ear, from entering the receiver tube. FIGS. 16-20 illustrate an arrangement for accommodating a wax guard 300 in a recess 310 provided in the tip surface 214 of the hearing instrument shell 10. The recess 310 is located where the receiver tube hole 222 would be positioned in the shell tip 12. The receiver tube 220 in this instance would terminate at the recess 310. The Boolean methods could be employed to remove material from the vent hole 242 that would be in the space occupied by the wax guard (see, e.g., FIGS. 17-19).

What is claimed is:

1. A hearing instrument, comprising:

a shell comprising a shell tip, the shell tip comprising a shell tip surface, the shell tip surface comprising a receiver tube hole and a vent hole;

a receiver tube connected to the receiver tube hole; and a vent connected to the vent hole, where the vent comprises a reduced portion adjacent the shell tip created by the virtual intersection of the receiver tube with the vent and the reduction of the interfering portion of the vent.

2. A hearing instrument as set forth in claim 1, where the reduced portion of the vent comprises a taper.

3. A hearing instrument as set forth in claim 1, where the vent hole is reduced in size.

4. A hearing instrument as set forth in claim 1, where the reduction of the vent comprises a Boolean subtraction.

5. A hearing instrument as set forth in claim 1, where the vent comprises a channel on the wall of the shell.

6. A hearing instrument as set forth in claim 1, where the receiver tube and the vent are positioned in proximity to one another and the reduced portion of the vent conforms to the portion of the receiver tube in proximity to the vent.

7. A hearing instrument as set forth in claim 1, where the reduced portion of the vent comprises a concave wall.

8. A hearing instrument as set forth in claim 1, where the portion of the receiver tube adjacent the receiver tube hole comprises a reduced portion.

9. A hearing instrument as set forth in claim 1, where the shell tip surface further comprises a recess at the receiver tube hole, for a wax guard.

* * * * *